US010916394B2

(12) United States Patent
Sakuyama et al.

(10) Patent No.: US 10,916,394 B2
(45) Date of Patent: Feb. 9, 2021

(54) GAS CIRCUIT BREAKER

(71) Applicant: Hitachi, Ltd., Tokyo (JP)

(72) Inventors: Toshiaki Sakuyama, Tokyo (JP); Hajime Urai, Tokyo (JP); Masanao Terada, Tokyo (JP); Ryoichi Shiobara, Tokyo (JP); Takahiro Nishimura, Tokyo (JP); Makoto Hirose, Tokyo (JP); Yuichiro Yamane, Tokyo (JP)

(73) Assignee: Hitachi, Ltd., Tokyo (JP)

( * ) Notice: Subject to any disclaimer, the term of this patent is extended or adjusted under 35 U.S.C. 154(b) by 0 days.

(21) Appl. No.: 16/645,667

(22) PCT Filed: Jul. 30, 2018

(86) PCT No.: PCT/JP2018/028383
§ 371 (c)(1),
(2) Date: Mar. 9, 2020

(87) PCT Pub. No.: WO2019/073660
PCT Pub. Date: Apr. 18, 2019

(65) Prior Publication Data

US 2020/0279705 A1 Sep. 3, 2020

(30) Foreign Application Priority Data

Oct. 12, 2017 (JP) ..... 2017-198175

(51) Int. Cl.
*H01H 33/91* (2006.01)
*H01H 33/56* (2006.01)

(52) U.S. Cl.
CPC ..... *H01H 33/91* (2013.01); *H01H 33/56* (2013.01)

(58) Field of Classification Search
CPC ..... H01H 33/91; H01H 33/56; H01H 33/565; H01H 33/7053; H01H 33/98;
(Continued)

(56) References Cited

U.S. PATENT DOCUMENTS 5,814,781 A * 9/1998 Koyanagi ..... H01H 33/904 218/60
6,515,248 B2 * 2/2003 Imamura ..... H01H 33/91 218/43

(Continued)

FOREIGN PATENT DOCUMENTS

JP 2013-125720 A 6/2013
JP 2015-106513 A 6/2015
WO WO 2015/174122 A1 11/2015

OTHER PUBLICATIONS

Translation JP2013125720 (Original document published Jun. 24, 2013) (Year: 2013).*

(Continued)

*Primary Examiner* — William A Bolton
(74) *Attorney, Agent, or Firm* — Crowell & Moring LLP

(57) ABSTRACT

A gas circuit breaker includes a gas suppresser composed of a protruded portion which is formed on a horizontal surface facing an exhaust cylinder of a shaft guide and which forms a gap between itself and the exhaust cylinder and an enlarged portion which is adjacent to the protruded portion and where a gap to the exhaust cylinder is enlarged so that the shaft guide, which operates along an inner circumferential surface of the exhaust cylinder, which is provided to an inner circumferential portion of a movable side main conductor and is provided to outer circumferences of an exhaust shaft and an operation rod, and couples the operation rod with the exhaust shaft, is axially adjacent to a sliding member that slides along the exhaust cylinder with no space to the exhaust cylinder and suppresses discharge of heated and pressurized insulating gas.

9 Claims, 5 Drawing Sheets

(58) Field of Classification Search
CPC ..... H01H 33/7023; H01H 33/42; H01H 2033/903; H01H 2033/906; H01H 2033/908
USPC ..... 218/52, 53, 57, 59, 60, 61
See application file for complete search history.

(56) References Cited

U.S. PATENT DOCUMENTS

| | | | | |
|---|---|---|---|---|
| 6,624,370 | B1 * | 9/2003 | Soga | H01H 33/02 218/154 |
| 6,664,494 | B2 * | 12/2003 | Kida | H01H 1/385 218/43 |
| 9,058,947 | B2 * | 6/2015 | Yaginuma | H01H 33/901 |
| 2010/0147804 | A1 * | 6/2010 | Yamada | H01H 33/90 218/63 |
| 2017/0148591 | A1 | 5/2017 | Nomura et al. | |

OTHER PUBLICATIONS

International Search Report (PCT/ISA/210) issued in PCT Application No. PCT/JP2018/028383 dated Oct. 9, 2018 with English translation (five pages).
Japanese-language Written Opinion (PCT/ISA/237) issued in PCT Application No. PCT/JP2018/028383 dated Oct. 9, 2018 (three pages).

* cited by examiner

GAS CIRCUIT BREAKER

TECHNICAL FIELD

The present invention relates to a gas circuit breaker, and in particular to a gas circuit breaker suitable for a puffer type circuit breaker using a mechanical compression action, a heating pressurization action by arc heat, or both of them.

BACKGROUND ART

The gas circuit breaker is to break an accidental current generated by an interphase short circuit, a ground fault, or the like in an electric power system, and a puffer type gas circuit breaker is widely used conventionally.

In the puffer type gas circuit breaker, a high-pressure gas flow is generated when a movable puffer cylinder directly connected to a movable arc contact mechanically compresses arc-extinguishing gas. Then, the gas flow is s blasted against an arc generated between the movable arc contact and a fixed arc contact and an electric current is broken.

Generally, circuit breaking performance of the gas circuit breaker depends on a pressure rise in a puffer chamber. Therefore, a heat/puffer combined type gas circuit breaker that raises pressure by actively utilizing heat energy of arc in addition to pressure rise by conventional mechanical compression is also widely used. The heat/puffer combined type gas circuit breaker forms blasting pressure of arc-extinguishing gas by utilizing the heat energy of arc. The heat/puffer combined type gas circuit breaker can reduce operation energy required for a circuit breaking operation as compared with a conventional method that mechanically compresses arc-extinguishing gas.

An object of both the puffer type gas circuit breaker and the heat/puffer combined type gas circuit breaker is to improve both the circuit breaking performance and the insulating performance. In particular, a high temperature and high pressure gas is generated by an arc generated when an accidental current is broken, and the gas is exhausted from an arc space into a filling container. Therefore, it is important to prevent insulation breakdown between a conductor through the exhausted high temperature and high pressure gas and the grounded filling container from a transient recovery voltage applied to the conductor immediately after break. Performance to prevent the insulation breakdown is called ground insulation performance.

While a breaking current increases due to increase of system capacity, cost reduction of the gas circuit breaker is required. Under such circumstances, improvement of the ground insulation performance is desired.

By the way, as a method of improving the ground insulation performance, there is a method of relaxing an electric field by increasing an insulation distance and/or smoothing a high electric field portion of the conductor.

As a prior art document for improving the ground insulation performance, there is Patent Literature 1. Patent Literature 1 describes a puffer type gas circuit breaker composed of a grounding container filled with insulating gas, a movable side conductor held by an insulating support cylinder in the grounding container, an exhaust cylinder coaxially provided in the movable side conductor, an insulating rod which is coaxially provided in the exhaust cylinder and in the insulating support cylinder and whose one end is coupled to an operation device, a puffer shaft coupled to the other end of the insulating rod through a shaft guide, a puffer cylinder which is coaxially coupled to the puffer shaft and has a movable arc contact, an insulating nozzle, and a movable main contact at an end portion from inside of concentric circle, a puffer chamber formed by the puffer cylinder, the puffer shaft, and a puffer piston, and a fixed side conductor having the movable arc contact, a fixed arc contact arranged to face the movable main contact, and a fixed main contact at one end. In the puffer type gas circuit breaker, the shaft guide slides in the exhaust cylinder with no space in between by a sliding member, the exhaust cylinder forms an exhaust chamber that fits into an inner circumference of the movable side conductor to be partitioned, each of the puffer shaft, the exhaust cylinder, and the movable side conductor has a hole through which gas generated between arc contacts is discharged, and the holes communicate with each other from when an arc is generated to when the circuit breaking operation is completed.

CITATION LIST

Patent Literature

Patent Literature 1: Japanese Unexamined Patent Application Publication No. 2013-125720 (in particular, see FIG. 5)

SUMMARY OF INVENTION

Technical Problem

The puffer type gas circuit breaker described in Patent Literature 1 improves the ground insulation performance by preventing high temperature and high pressure insulating gas (hereinafter referred to as "high temperature and high pressure gas") from being discharged from inside of the exhaust cylinder to the insulating support cylinder by the sliding member provided to the shaft guide.

However, in the technique described in Patent Literature 1, a gap between the sliding member provided to the shaft guide and the exhaust cylinder is reduced in order to reduce discharge of the high temperature and high pressure gas into the insulating support cylinder, so that sliding resistance with the exhaust cylinder increases and the circuit breaking operation may be influenced.

Thus, the technique described in Patent Literature 1 has a problem for achieving both the ground insulation performance and the circuit breaking operation. Specifically, to improve the ground insulation performance, the sliding member only needs to prevent the high temperature and high pressure gas from being discharged from inside of the exhaust cylinder to the insulating support cylinder. However, when the sliding member is provided, the sliding resistance with the exhaust cylinder increases and the circuit breaking operation may be influenced. Therefore, Patent Literature 1 has a problem of improving both of them.

The present invention is made in view of the above problems, and an object of the present invention to provide a gas circuit breaker that reduces an amount of the high temperature and high pressure gas discharged into the insulating support cylinder and improves both the ground insulation performance and the circuit breaking performance while lowering the sliding resistance of the exhaust cylinder and reducing the effects on the circuit breaking operation.

Solution to Problem

To achieve the object described above, the gas circuit breaker of the present invention is characterized by including a filling container filled with insulating gas having arc-extinguishing properties, a movable side main conductor which is supported and fixed by an insulating support cylinder arranged inside the filling container, is connected to a movable side lead-out conductor connected to an electric power system, and has an exhaust hole for exhausting insulating gas heated and pressurized by an arc generated when a current is broken, an exhaust shaft which is provided movably in an axis direction of the movable side main conductor inside the movable side main conductor and has a shaft exhaust hole for exhausting the heated and pressurized insulating gas, an operation mechanism which is coupled to the exhaust shaft and outputs an operation force in an axis direction of the exhaust shaft through an operation rod, an exhaust cylinder which is provided to an inner circumferential portion of the movable side main conductor and is provided to outer circumferences of the exhaust shaft and the operation rod, a shaft guide which couples the operation rod with the exhaust shaft and operates along an inner circumferential surface of the exhaust cylinder, a cylinder which is coaxially coupled to the exhaust shaft and can slide in an axis direction on an inner circumferential surface of the movable side main conductor, a puffer piston which is fixed to inside of the movable side main conductor and has an opening portion that opens in the axis direction of the movable side main conductor and where the exhaust shaft can slide on an inner circumferential surface of the opening portion, a movable contact which is electrically connected to the movable side lead-out conductor, a fixed contact which is electrically connected to a fixed side lead-out conductor connected to an electric power system and is attachable to and detachable from the movable contact, and a sliding member which is mounted on the shaft guide and slides along the exhaust cylinder with no space to the exhaust cylinder. Here, the shaft guide includes a gas suppressing means, which suppresses discharge of the heated and pressurized insulating gas, adjacent to the sliding member in an axis direction.

Specifically, the gas suppressing means is characterized by being composed of a protruded portion which is formed on a horizontal surface facing the exhaust cylinder of the shaft guide and which forms a gap between itself and the exhaust cylinder, and an enlarged portion which is adjacent to the protruded portion and where a gap to the exhaust cylinder is enlarged.

Advantageous Effects of Invention

According to the present invention, it is possible to reduce the amount of the high temperature and high pressure gas discharged into the insulating support cylinder and improve both the ground insulation performance and the circuit breaking performance while lowering the sliding resistance of the exhaust cylinder and reducing the effects on the circuit breaking operation.

DESCRIPTION OF EMBODIMENTS

Figure 1:
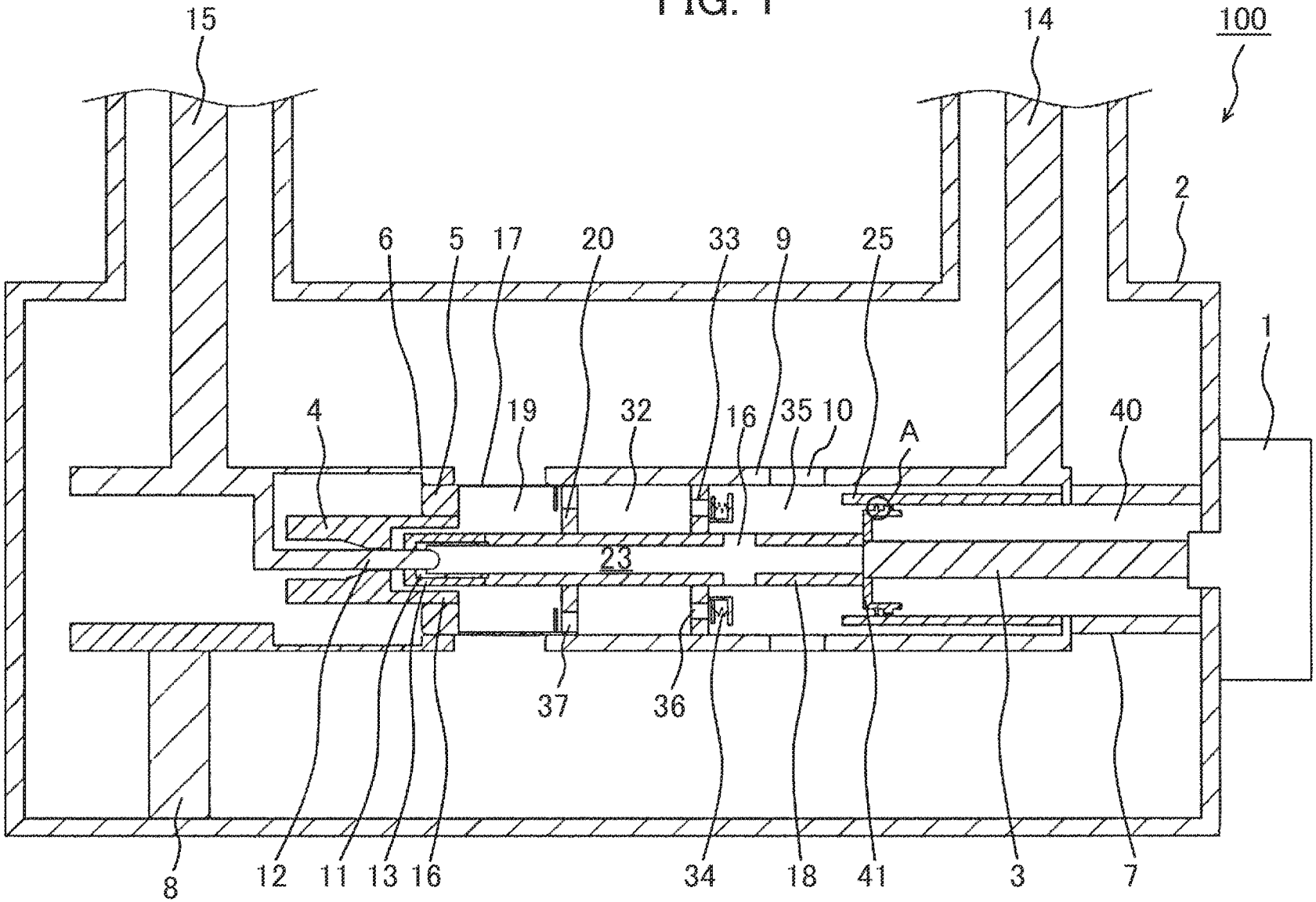
FIG. 1 is a cross-sectional view showing a schematic configuration of a first embodiment of a gas circuit breaker of the present invention.

Hereinafter, the gas circuit breaker of the present invention will be described based on the embodiments shown in the drawings. In the embodiments described below, the same components are denoted by the same reference numerals. Further, an "axis direction" in the present description indicates a direction of a central axis of a cylinder constituting a movable side main conductor 9 (a left-right (horizontal) direction in FIG. 1), and hereinafter the "axis direction" indicates the direction described above unless otherwise specified.

First Embodiment

FIG. 1 shows is a schematic configuration of a first embodiment of a gas circuit breaker 100 of the present invention.

The gas circuit breaker 100 of the present embodiment shown in FIG. 1 is arranged in the middle of an electric power system (a high voltage circuit or the like), and when an accidental current is generated by a stroke of lightning or the like, the gas circuit breaker 100 stops energization of the electric power system by electrically disconnecting the electric power system. The gas circuit breaker 100 shown in FIG. 1 is an example of a puffer type gas circuit breaker.

The gas circuit breaker 100 of the present embodiment shown in FIG. 1 is characterized by being roughly composed of a filling container 2 filled with insulating gas (for example, sulfur hexafluoride gas) having arc-extinguishing properties, a movable side main conductor 9 which is supported and fixed by an insulating support cylinder 7 arranged inside the filling container 2, is connected to a movable side lead-out conductor connected to an electric power system (high voltage circuit), and has an exhaust hole 10 for exhausting insulating gas heated and pressurized by an arc generated when a current is broken, an exhaust shaft 18 which is provided movably in the axis direction of the movable side main conductor 9 inside the movable side main conductor 9 and has a shaft exhaust hole 16 for exhausting heated and pressurized insulating gas, an operation mechanism 1 which is coupled to the exhaust shaft 18 and outputs an operation force in an axis direction of the exhaust shaft 18 through an operation rod 3, an exhaust cylinder 25 which is provided to an inner circumferential portion of the movable side main conductor 9 and is provided to outer circumferences of the exhaust shaft 18 and the operation rod 3, a shaft guide 41 which couples the operation rod 3 with the exhaust shaft 18 and operates along an inner circumferential surface of the exhaust cylinder 25, a cylinder 17 which is coaxially coupled to the exhaust shaft 18 and can slide in the axis direction on an inner circumferential surface of the movable side main conductor 9, a puffer piston 33 which is fixed to the inside of the movable side main conductor 9 and has an opening portion that opens in the axis direction of the movable side main conductor 9 and where the exhaust shaft 18 can slide on an inner circumferential surface of the opening portion, a movable main contact (movable contact) 5 electrically connected to a movable side lead-out conductor 14, a fixed main contact (fixed contact) 6 which is electrically connected to a fixed side lead-out conductor 15 connected to the electric power system and is attachable to and detachable from the movable contact, and a sliding member 42 (see FIG. 2) which is mounted on the shaft guide 41 and which consists of, for example, resin and slides along the exhaust cylinder 25 with no space to the exhaust cylinder 25. In the present embodiment, the shaft guide 41 is provided with a gas suppressing means (portion A in FIGS. 1 and 2), which suppresses discharge of heated and pressurized insulating gas, adjacent to an upstream side in the axis direction of the sliding member 42.

More specifically, the gas circuit breaker 100 of the present embodiment includes the movable side main conductor 9, the exhaust shaft 18, the cylinder 17, the puffer piston 33, and the shaft guide 41, and these components are arranged inside the filling container 2 of insulating gas (for example, sulfur hexafluoride gas) having arc-extinguishing properties. The movable main contact 5 and a movable arc contact 11 (both of them are movable arc contacts) are provided on the front side of the exhaust shaft 18 (left in FIG. 1). These are electrically connected to the movable side lead-out conductor 14 connected to the electric power system.

The fixed main contact 6 and a fixed arc contact 12 (both of them are fixed contacts) that are attachable to and detachable from the movable main contact 5 and the movable arc contact 11 are supported and fixed by a fixed side insulating cylinder 8 and electrically connected to the fixed side lead-out conductor 15 connected to the electric power system. Therefore, when an accidental current is generated by a stroke of lightning or the like as described above, the movable main contact 5 and the movable arc contact 11 are detached from the fixed main contact 6 and the fixed arc contact 12, so that the energization of the electric power system is stopped.

The movable side main conductor 9 described above is supported and fixed by the insulating support cylinder 7 arranged inside the filling container 2. The movable side main conductor 9 has a cylindrical shape. Although the details will be described later, the cylinder 17 can slide inside the movable side main conductor 9. The exhaust hole 10 for exhausting high temperature and high pressure insulating gas (high temperature and high pressure gas) from the inside of the movable side main conductor 9 to the inside of the filling container 2 is formed in a side surface of the filling container 2. The high temperature and high pressure gas is generated when insulating gas is heated and pressurized by an arc generated when the movable arc contact 11 is detached from the fixed arc contact 12. The flow of the high temperature and high pressure gas and the insulating gas will be described later with reference to FIGS. 2 and 3.

The exhaust shaft 18 is a hollow shaft provided inside the movable side main conductor 9 coaxially with the movable side main conductor 9. A flow path 23 through which the high temperature and high pressure gas generated by the arc described above flows is formed inside the exhaust shaft 18. The shaft exhaust hole 16 for exhausting the high temperature and high pressure gas flown through the flow path 23 to the outside of the exhaust shaft 18 is formed in a side surface on the rear side of the exhaust shaft 18 (right in FIG. 1).

The operation mechanism 1 that outputs an operation force in the axis direction of the exhaust shaft 18 is coupled to the exhaust shaft 18. In FIG. 1, the operation mechanism 1 is coupled to the exhaust shaft 18 through the operation rod 3. When an accidental current or the like occurs, a movement instruction from an output unit not shown in the drawings is inputted into the operation mechanism 1.

By the movement instruction from the output unit, the operation mechanism 1 moves the exhaust shaft 18 to rearward (right in FIG. 1) through the operation rod 3, and thereby the movable main contact 5 and the movable arc contact 11 are detached from the fixed main contact 6 and the fixed arc contact 12 and the electric power system is broken.

The operation rod 3 is coupled to the exhaust shaft 18 through the shaft guide 41. The shaft guide 41 is attached movably in the axis direction to an inner circumference of the exhaust cylinder 25.

The cylinder 17 is coupled to the exhaust shaft 18 coaxially with the exhaust shaft 18. The cylinder 17 can slide inside the movable side main conductor 9 having a cylindrical shape along with the movement of the exhaust shaft 18 in the axis direction.

A piston 20 is arranged on the rear side of the cylinder 17 (right in FIG. 1), and a mechanical puffer chamber 32 is formed inside the movable side main conductor 9 and between the piston 20 and a puffer piston 33 (described later). Therefore, when the exhaust shaft 18 and the cylinder 17 move rearward, insulating gas inside the mechanical puffer chamber 32 is compressed.

A heat puffer chamber 19 is formed inside the cylinder 17 and on the front side of the piston 20. Although the details will be described later, the high temperature and high pressure gas generated by the arc is introduced into the heat puffer chamber 19. The heat puffer chamber 19, the mechanical puffer chamber 32, and a movable side conductor inner circumferential space 35 described later communicate with each other in series through holes 36 and 37 formed so as to surround the exhaust shaft 18 in order of the heat puffer chamber 19, the mechanical puffer chamber 32, and the movable side conductor inner circumferential space 35.

Further, the movable main contact 5 is arranged at the front end of the cylinder 17 (left in FIG. 1), and the movable arc contact 11 is arranged at the front end of the exhaust shaft 18 so as to be surrounded by the movable main contact 5. The movable arc contact 11 faces the inside of the exhaust shaft 18 (that is, the flow path 23), and the movable arc contact 11 is covered with a mover cover 13. An insulating nozzle 4 is arranged at the front end of the cylinder 17 so as to surround the movable arc contact 11 and the fixed arc contact 12.

The puffer piston 33 is a disk-shaped piston fixed inside the movable side main conductor 9. A region close to the center of the puffer piston 33 is opened, and the exhaust shaft 18 is inserted into the opening. Thereby, the exhaust shaft 18 can slide on an inside surface of the opening of the fixed puffer piston 33 and move in the axis direction.

The movable side conductor inner circumferential space 35 is formed inside the movable side main conductor 9 and on the rear side of the puffer piston 33. Further, the mechanical puffer chamber 32 described above is formed inside the movable side main conductor 9 and on the front side of the puffer piston 33. The puffer piston 33 is formed with the hole 36 that makes the movable side conductor inner circumferential space 35 and the mechanical puffer chamber 32 communicate with each other so as to surround the exhaust shaft 18.

Figure 2:
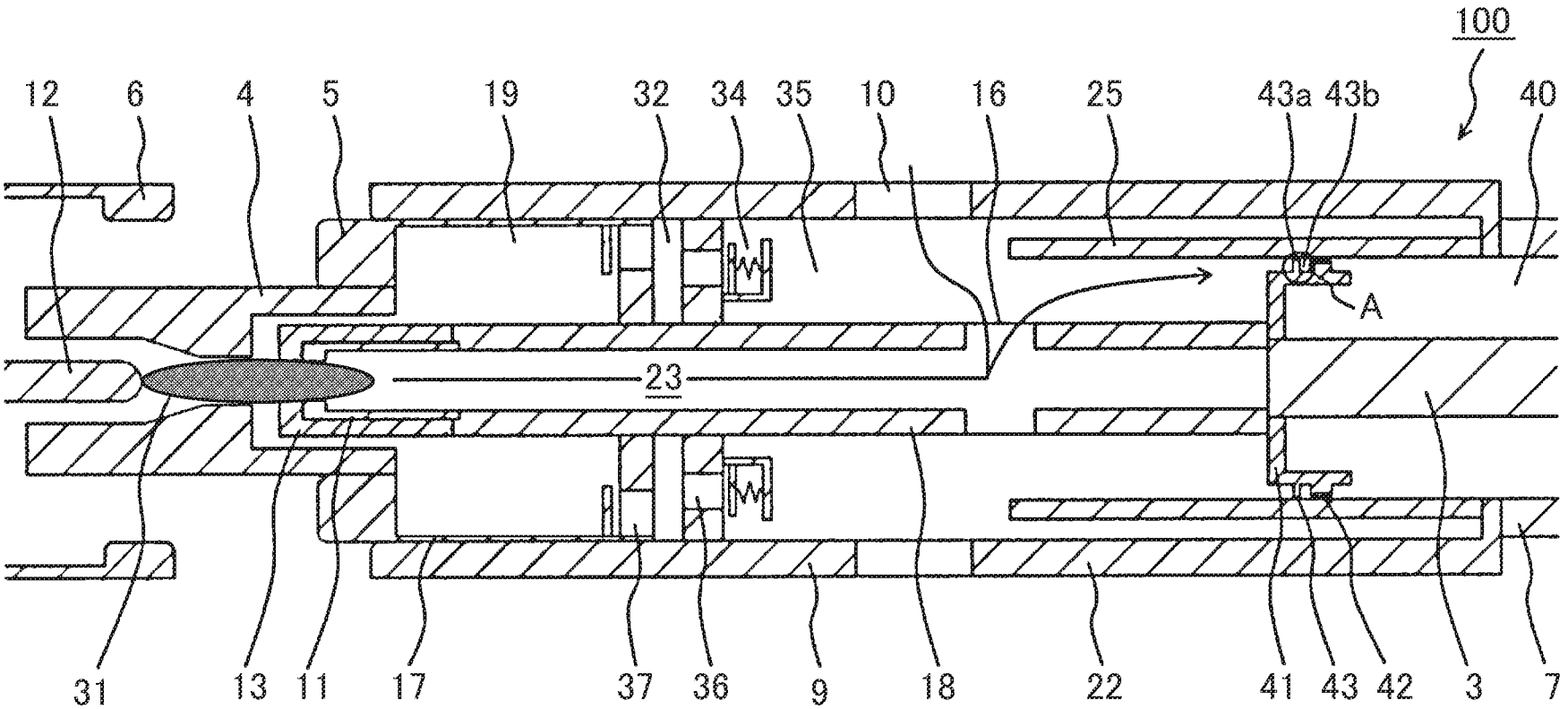
FIG. 2 is a cross-sectional view of the gas circuit breaker showing a flow of insulating gas in an opening state of the first embodiment of the gas circuit breaker of the present invention.

FIG. 2 shows a flow of insulating gas in an opening state of the gas circuit breaker 100 of the present embodiment.

Usually, when the accidental current described above occurs, the operation mechanism 1 moves the exhaust shaft 18 to rearward (right in FIG. 2) through the operation rod 3. Thereby, the cylinder 17 (including the piston 20) integrally formed with the exhaust shaft 18, the movable main contact 5, the movable arc contact 11, the mover cover 13, and the insulating nozzle 4 are also moved rearward.

Thereby, the movable main contact 5 is detached from the fixed main contact 6 (that is, a circuit breaking operation is performed), energization of the electric power system is stopped, that is, an opening state shown in FIG. 2 occurs.

When the opening state shown in FIG. 2 occurs, if the movable arc contact 11 and the fixed arc contact 12 are separated from each other, an arc is generated between the movable arc contact 11 and the fixed arc contact 12 inside the insulating nozzle 4. The arc is generated in an arc space 31 shown in FIG. 2. The insulating gas near the arc space 31 is heated by the arc generated in the arc space 31. Then, a part of the insulating gas that is heated and pressurized in the arc space 31 (high temperature and high pressure gas) is introduced into the heat puffer chamber 19 formed inside the cylinder 17. On the other hand, a large part of the high temperature and high pressure gas flows through the flow path 23 inside the exhaust shaft 18 as indicated by an arrow in FIG. 2.

The high temperature and high pressure gas that has flown through the flow path 23 is separated into two directions, and one high temperature and high pressure gas flows through the shaft exhaust hole 16, the movable side main conductor inner circumferential space 35, and the exhaust hole 10 and is exhausted to the outside of the movable side main conductor 9. The other high temperature and high pressure gas flows into an inner circumferential space of the exhaust cylinder 25 and flows out to an inner circumferential space 40 of the insulating support cylinder 7 through a gap between the shaft guide 41 and the exhaust cylinder 25.

In FIG. 2, for convenience of description, only a flow of the high temperature and high pressure gas that flows upward is shown. However, practically, a flow of the high temperature and high pressure gas that flows downward is also generated (the same applies hereinafter). Here, the arc space 31 is defines as an upstream side and a direction to the shaft guide 41 is defined as a downstream side.

Figure 3:
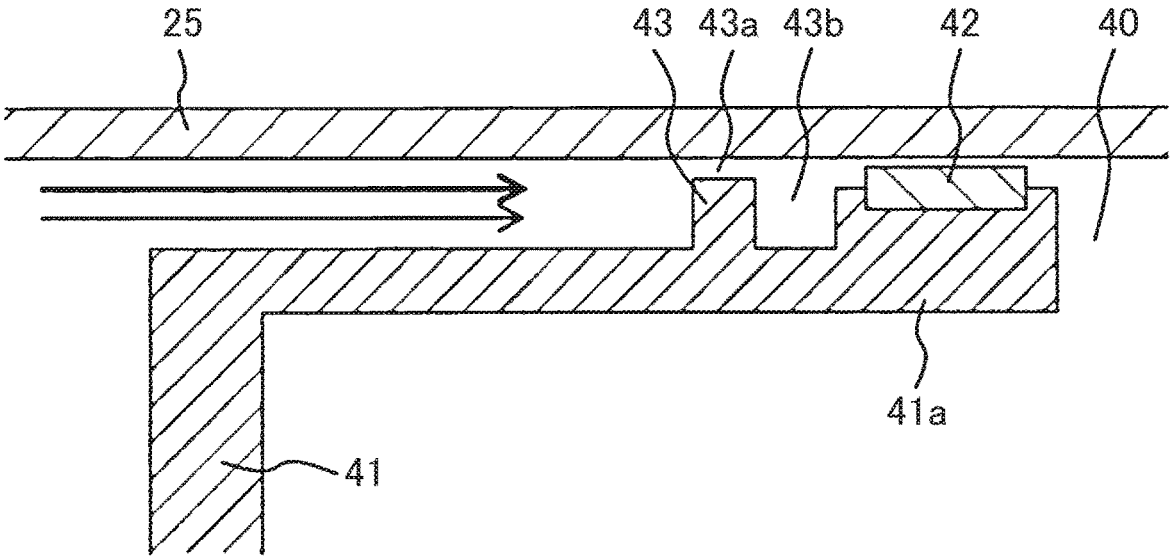
FIG. 3 is a partial cross-sectional view of a portion close to a shaft guide showing an opening state in the gas circuit breaker according to the first embodiment of the gas circuit breaker of the present invention.

FIG. 3 is a diagram showing a portion close to the shaft guide 41 in an opening state of the gas circuit breaker 100 according to the present embodiment. FIG. 3 shows details of the gas suppressing means that suppresses the discharge of above-mentioned heated and pressurized insulating gas.

As shown in FIG. 3, the gas suppressing means of the present embodiment is composed of a protruded portion 43 which is formed on the exhaust shaft 18 side of the sliding member 42 mounted on a rear end portion 41*a* of the shaft guide 41 (on the left side of FIG. 3 and on the upstream side of the sliding member 42) and on a horizontal surface facing the exhaust cylinder 25 of the shaft guide 41 and which forms a gap between the protruded portion 43 and the exhaust cylinder 25, and an enlarged portion 43*b* which is adjacent to the protruded portion 43 and where a gap 43*a* between the protruded portion 43 and the exhaust cylinder 25 is suddenly enlarged.

The high temperature and high pressure gas indicated by an arrow, which has flown into the inner circumferential space of the exhaust cylinder 25, described in FIG. 2 flows out to the inner circumferential space 40 of the insulating support cylinder 7 through the gap between the exhaust cylinder 25 and the shaft guide 41.

However, in the gas circuit breaker 100 of the present embodiment, the sliding member 42 is provided on the rear end portion 41*a* of the shaft guide 41, the protruded portion 43 that forms the gap 43*a* between itself and the inner circumferential surface of the exhaust cylinder 25 is formed on a surface of the shaft guide 41 facing the inner circumferential surface of the exhaust cylinder 25, and the enlarged portion 43*b* where the gap 43*a* between the protruded portion 43 and the inner circumferential surface of the exhaust cylinder 25 is suddenly enlarged is formed on the adjacent downstream side of the protruded portion 43 (a so-called labyrinth portion is formed by using the gap 43*a* and the enlarged portion 43*b* as a pair).

By configuring as described above, there is the enlarged portion 43*b* where the gap 43*a* between the protruded portion 43 and the inner circumferential surface of the exhaust cylinder 25 is suddenly enlarged is formed on the adjacent downstream side of the protruded portion 43, so that it is possible to reduce the high temperature and high pressure gas that flows out from the inside of the exhaust cylinder 25 into the insulating support cylinder 7 by pressure loss effects of the gap 43*a* and the enlarged portion 43*b*.

Further, a gap between the sliding member 42 and the exhaust cylinder 25 can enlarge to a level at which a posture can be kept during operation, so that it is possible to reduce sliding resistance.

Thereby, discharge of the high temperature and high pressure gas into the insulating support cylinder 7 is suppressed by the labyrinth portion (gas suppressing means), so that it is possible to prevent the high temperature and high pressure gas generated by the arc from coming into contact with the sliding member 42, and thereby the durability of the sliding member 42 can be improved. Further, foreign objects such as, for example, metal particles included in the insulating gas and the high temperature and high pressure gas generated by the arc are captured by the labyrinth portion, so that it is possible to prevent the foreign objects from being transported to the inner circumferential space 40 of the insulating support cylinder 7, so that insulating performance can be improved.

Therefore, according to the present embodiment, while lowering the sliding resistance of the exhaust cylinder 25 and reducing the effect on the circuit breaking operation, it is possible to reduce the amount of high temperature and high pressure gas discharged into the insulating support cylinder 7 and improve both the ground insulation performance and the circuit breaking performance.

Second Embodiment

Figure 4:
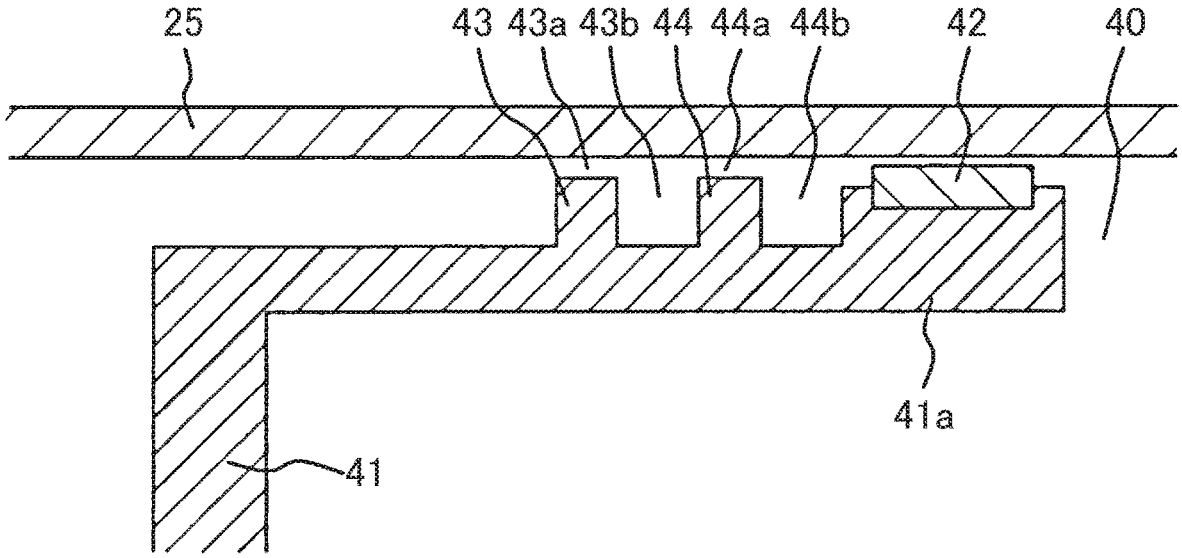
FIG. 4 is a partial cross-sectional view of a portion close to a shaft guide showing an opening state in a gas circuit breaker according to a second embodiment of the gas circuit breaker of the present invention.

FIG. 4 shows a second embodiment of the gas circuit breaker 100 of the present invention. FIG. 4 is a diagram of a portion close to the shaft guide 41 in the opening state of the gas circuit breaker 100.

The gas circuit breaker 100 of the present embodiment shown in FIG. 4 is characterized in that a plurality of (in the present embodiment, two) labyrinth portions (the gas suppressing means described in the first embodiment), each of which is composed of the gap 43*a* and the enlarged portion 43*b* of the shaft guide 41 and the exhaust cylinder 25, are provided to the shaft guide 41 on the upstream side of the sliding member 42 (left side of FIG. 4, and on the exhaust shaft 18 side in FIG. 2).

In the case of the present embodiment shown in FIG. 4, there are two labyrinth portions, which are a labyrinth portion formed from a pair of the gap 43*a* made by the protruded portion 43 and the enlarged portion 43*b* and a labyrinth portion formed from a pair of a gap 44*a* made by a protruded portion 44 and an enlarged portion 44*b*.

According to the present embodiment as described above, of course, the same effects as those of the first embodiment can be obtained, and further it is possible to more effectively suppress discharge of the high temperature and high pressure gas to the inner circumferential space 40 of the insulating support cylinder 7 by providing two or more labyrinth portions.

Third Embodiment

Figure 5:
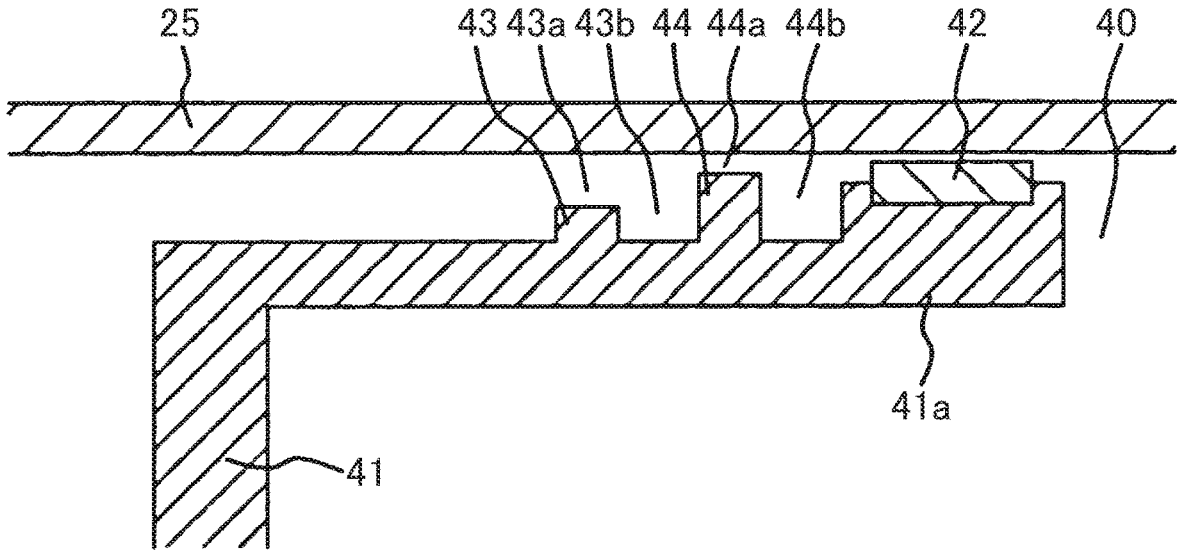
FIG. 5 is a partial cross-sectional view of a portion close to a shaft guide showing an opening state in a gas circuit breaker according to a third embodiment of the gas circuit breaker of the present invention.

FIG. 5 shows a third embodiment of the gas circuit breaker 100 of the present invention. FIG. 5 is a diagram of a portion close to the shaft guide 41 in the opening state of the gas circuit breaker 100.

The gas circuit breaker 100 of the present embodiment shown in FIG. 5 is characterized in that the shaft guide 41 is provided with two labyrinth portions formed from the protruded portion 43 and the protruded portion 44, and among the two labyrinth portions, a radial direction cross sectional area of the gap 43*a* formed between the protruded portion 43 located on the upstream side of the sliding member 42 (left side of FIG. 5, and on the exhaust shaft 18 side in FIG. 2) and the exhaust cylinder 25 is greater than a radial direction cross sectional area of the gap 44*a* formed between the protruded portion 44 located closer to the sliding member 42 than the protruded portion 43 and the exhaust cylinder 25.

This also means that among the two labyrinth portions, the gap 43*a* formed between the protruded portion 43 located on the upstream side of the sliding member 42 (left side of FIG. 5, and on the exhaust shaft 18 side in FIG. 2) and the exhaust cylinder 25 is greater than the gap 44*a* formed between the protruded portion 44 located closer to the sliding member 42 than the protruded portion 43 and the exhaust cylinder 25.

When the circuit breaking operation of the gas circuit breaker 100 is performed, the sliding member 42 comes into contact with the exhaust cylinder 25, so that a portion that operates along with the circuit breaking operation operates using the sliding member 42 as a supporting point.

According to the present embodiment as described above, of course, the same effects as those of the first embodiment can be obtained, and further it is possible to prevent the protruded portion 43 located on the upstream side of the sliding member 42 from coming into contact with the inner circumference of the exhaust cylinder 25 and it is possible to keep the effect of discharge suppression of the high temperature and high pressure gas by the labyrinth portion. Furthermore, it is also possible to prevent generation of foreign objects due to contact between the protruded portion 43 and the exhaust cylinder 25, so that insulating performance can be improved.

Fourth Embodiment

Figure 6:
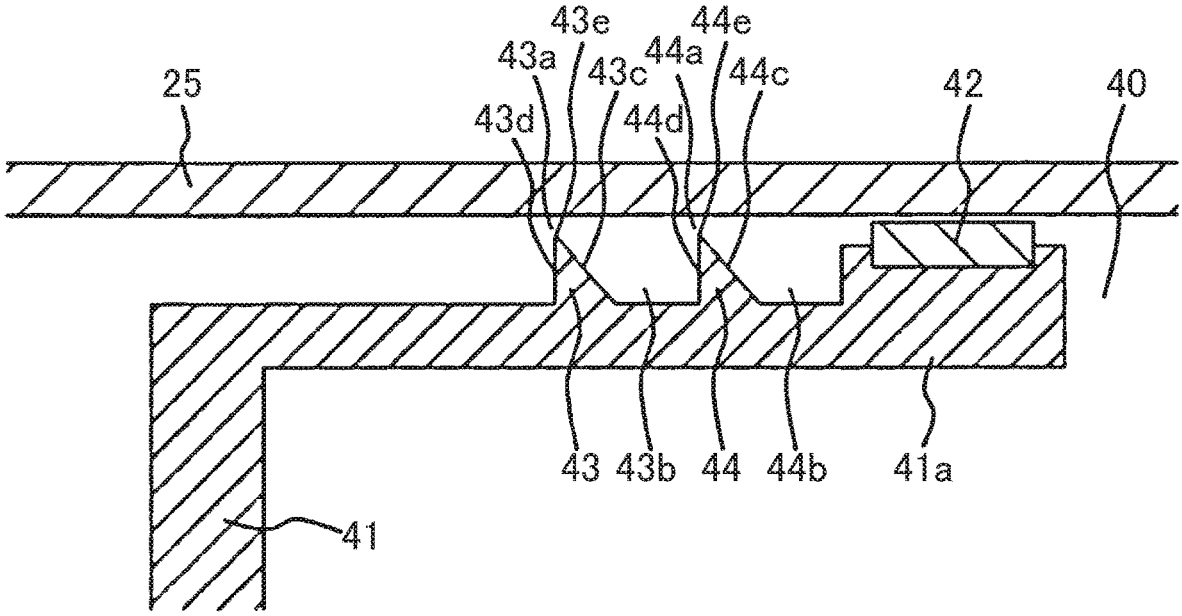
FIG. 6 is a partial cross-sectional view of a portion close to a shaft guide showing an opening state in a gas circuit breaker according to a fourth embodiment of the gas circuit breaker of the present invention.

FIG. 6 shows a fourth embodiment of the gas circuit breaker 100 of the present invention. FIG. 6 is a diagram of a portion close to the shaft guide 41 in the opening state of the gas circuit breaker 100.

The gas circuit breaker 100 of the present embodiment shown in FIG. 6 is characterized in that the shaft guide 41 is provided with two labyrinth portions formed from a pair of the protruded portion 43 and the enlarged portion 43*b* and a pair of the protruded portion 44 and the enlarged portion 44*b* on the upstream side of the sliding member 42 (left side of FIG. 6, and on the exhaust shaft 18 side in FIG. 2), the protruded portions 43 and 44 of respective labyrinth portions have vertical edge portions 43*d* and 44*d* on the exhaust shaft 18 (left of FIG. 6) side and inclined edge portions 43*c* and 44*c* on the sliding member 42 (right of FIG. 6) side, vertex portions 43*e* and 44*e* where the vertical edge portions 43*d* and 44*d* on the exhaust shaft 18 side and the inclined edge portions 43*c* and 44*c* on the sliding member 42 side meet are formed at an acute angle, the protruded portions 43 and 44 respectively have the vertex portions 43*e* and 44*e* as their vertexes, and right triangles are formed by the vertical edge portions 43*d* and 44*d* on the exhaust shaft 18 side which are perpendicular from the vertex portions 43*e* and 44*e* to the horizontal surface of the shaft guide 41 and the inclined edge portions 43*c* and 44*c* on the sliding member 42 side which are inclined from the vertex portions 43*e* and 44*e* with respect to the horizontal surface of the shaft guide 41.

In other words, the right triangles are formed by the vertex portions 43*e* and 44*e* used as vertexes, the vertical edge portions 43*d* and 44*d* on the upstream side (the exhaust shaft 18 side) which are perpendicular from the vertex portions 43*e* and 44*e* to the horizontal surface of the shaft guide 41, and the inclined edge portions 43*c* and 44*c* on the downstream side (the sliding member 42 side) which are inclined from the vertex portions 43*e* and 44*e* with respect to the horizontal surface of the shaft guide 41.

According to the present embodiment as described above, of course, the same effects as those of the first embodiment can be obtained, and further it is possible to prevent foreign objects included in the insulating gas and the high temperature and high pressure gas generated by the arc from clogging the gaps 43*a* and 44*b* formed by the protruded portions 43 and 44 by forming the vertex portions 43*e* and 44*e* of the protruded portions 43 and 44 into acute angles.

In FIG. 6, the vertical edge portions 43*d* and 44*d* on the upstream side of the protruded portions 43 and 44 cross a central axis at right angles. However, in the present embodiment, the vertical edge portions 43*d* and 44*d* may have angles with respect to the central axis. Chamfering processing and rounding processing, which do not damage the effect of the labyrinth portions, may be applied to the vertex portions 43*e* and 44*e*. Further, the vertex portions 43*e* and 44*e* only need to have acute angles, so that combinations of inclinations of the vertical edge portions 43*d* and 44*d* on the upstream side of the protruded portions 43 and 44 and the inclined edge portions 43*c* and 44*c* on the downstream side of the protruded portions 43 and 44 with respect to the central axis can be arbitrary, and when a plurality of labyrinth portions are provided, the combinations of inclinations of edge portions need not be the same.

Fifth Embodiment

Figure 7:
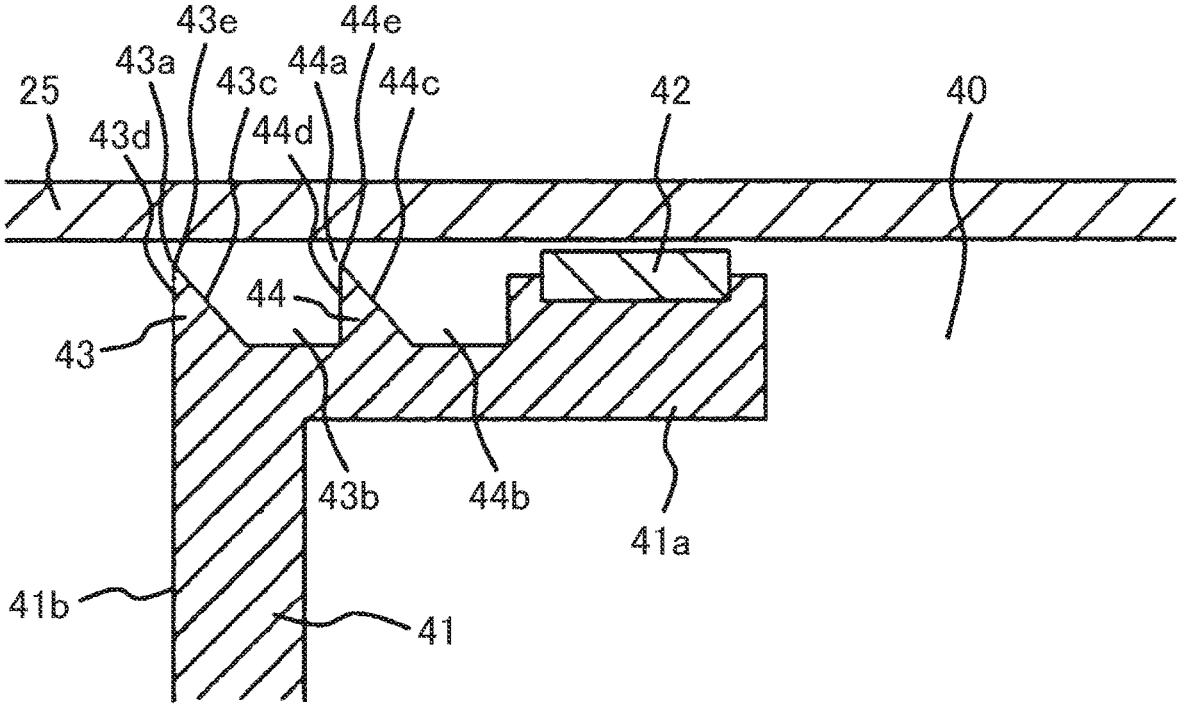
FIG. 7 is a partial cross-sectional view of a portion close to a shaft guide showing an opening state in a gas circuit breaker according to a fifth embodiment of the gas circuit breaker of the present invention.

FIG. 7 shows a fifth embodiment of the gas circuit breaker 100 of the present invention. FIG. 7 is a diagram of a portion close to the shaft guide 41 in the opening state of the gas circuit breaker 100.

The gas circuit breaker 100 of the present embodiment shown in FIG. 6 is a modified example of the fourth embodiment shown in FIG. 6. A difference from the fourth embodiment is characterized in that the vertical edge portion 43*d* on the exhaust shaft 18 (left of FIG. 7) side which is perpendicular from the vertex portion 43*e* of the protruded portion 43 to the horizontal surface of the shaft guide 41 and a surface 41*b* on the exhaust shaft 18 side of the shaft guide 41 are on the same plane. The other configurations are the same as those of the fourth embodiment shown in FIG. 6.

In the present embodiment, being on the same plane means that the vertical edge portion 43*d* on the exhaust shaft 18 side which is perpendicular from the vertex portion 43*e* of the protruded portion 43 to the horizontal surface of the shaft guide 41 and the surface 41*b* on the exhaust shaft 18 side of the shaft guide 41 are connected to each other without through two or more vertexes.

According to the present embodiment as described above, of course, the same effects as those of the first embodiment can be obtained, and further it is possible to shorten the length in the axis direction of the shaft guide 41, so that it is possible to lighten the shaft guide 41 and reduce the cost of the shaft guide 41.

Sixth Embodiment

Figure 8:
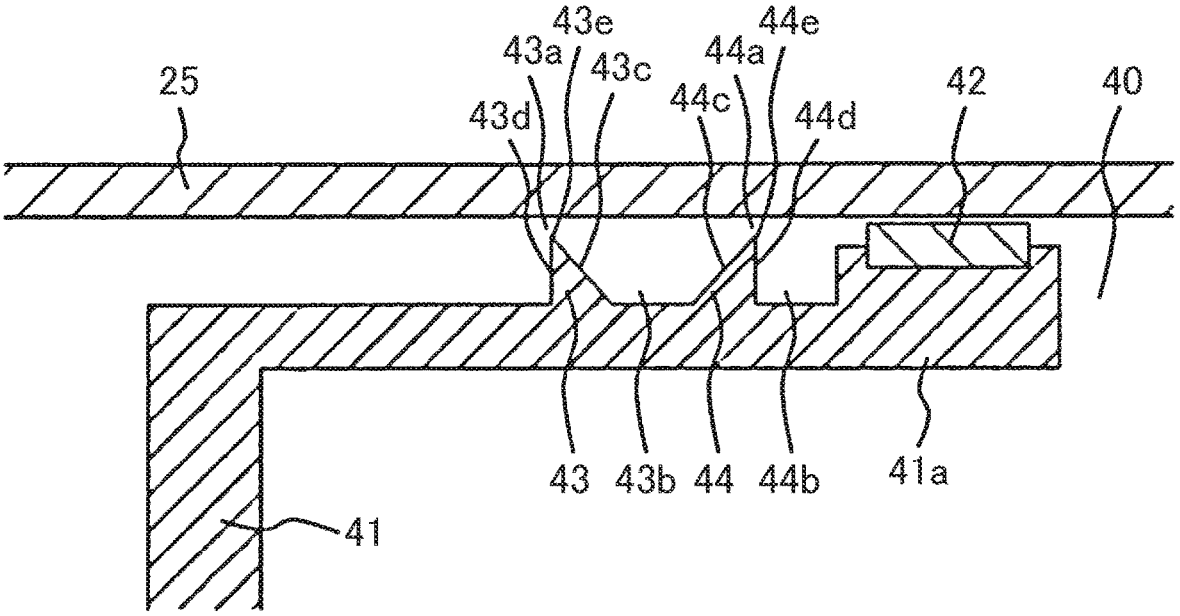
FIG. 8 is a partial cross-sectional view of a portion close to a shaft guide showing an opening state in a gas circuit breaker according to a sixth embodiment of the gas circuit breaker of the present invention.

FIG. 8 shows a sixth embodiment of the gas circuit breaker 100 of the present invention. FIG. 8 is a diagram of a portion close to the shaft guide 41 in the opening state of the gas circuit breaker 100.

The gas circuit breaker 100 of the present embodiment shown in FIG. 8 is characterized in that the shaft guide 41 is provided with two labyrinth portions formed from a pair of the protruded portion 43 and the enlarged portion 43*b* and a pair of the protruded portion 44 and the enlarged portion 44*b* on the upstream side of the sliding member 42 (left side of FIG. 8, and on the exhaust shaft 18 side in FIG. 2), among the protruded portions 43 and 44 of the labyrinth portions, the protruded portion 43 on the exhaust shaft 18 (left of FIG. 8) side has the vertex portion 43*e* as its vertex, a right triangle is formed by the vertical edge portion 43*d* on the exhaust shaft 18 side which is perpendicular from the vertex portion 43*e* to the horizontal surface of the shaft guide 41 and the inclined edge portion 43*c* on the sliding member 42 (right of FIG. 8) side which is inclined from the vertex portion 43*e* with respect to the horizontal surface of the shaft guide 41, the protruded portion 44 on the sliding member 42 side has the vertex portion 44*e* as its vertex, and a right triangle is formed by the vertical edge portion 44*d* on the sliding member 42 side which is perpendicular from the vertex portion 44*e* to the horizontal surface of the shaft guide 41 and the inclined edge portion 44*c* on the exhaust shaft 18 side which is inclined from the vertex portion 44*e* with respect to the horizontal surface of the shaft guide 41.

According to the present embodiment as described above, of course, the same effects as those of the first embodiment can be obtained.

In each embodiment described above, the fixed arc contact 12 and the fixed main contact 6 are described to be fixed for convenience. However, also in the case of a so-called bidirectional drive system where the fixed arc contact 12 and the fixed main contact 6 operate, each embodiment described above can be applied in the same manner.

The above embodiments are described in detail in order to describe the present invention in an easily understandable manner, and the embodiments are not necessarily limited to those that include all the components described above. Further, some components of a certain embodiment can be replaced by components of another embodiment, and components of a certain embodiment can be added to components of another embodiment. Further, regarding some components of each embodiment, it is possible to perform addition/deletion/exchange of other components.

LIST OF REFERENCE SIGNS

1 operation mechanism, 2 filling container, 3 operation rod, 4 insulating nozzle, 5 movable main contact (movable contact), 6 fixed main contact (fixed contact), 7 insulating support cylinder, 8 fixed side insulating cylinder, 9 movable side main conductor, 10 exhaust hole, 11 movable arc contact (movable contact), 12 fixed arc contact (fixed contact), 13 mover cover, 14 movable side lead-out conductor, 15 fixed side lead-out conductor, 16 shaft exhaust hole, 17 cylinder, 18 exhaust shaft, 19 heat puffer chamber, 20 piston, 23 flow path of exhaust shaft, 25 exhaust cylinder, 31 arc space, 32 mechanical puffer chamber, 33 puffer piston, 34 pressure releasing valve, 35 movable side conductor inner circumferential space, 36, 37 hole, 40 inner circumferential space of insulating support cylinder, 41 shaft guide, 41*a* rear end portion of shaft guide, 41*b* edge portion of shaft guide, 42 sliding member, 43, 44 protruded portion, 43*a*, 44*a* gap, 43*b*, 44*b* enlarged portion, 43*c*, 44*c* inclined edge portion, 43*d*, 44*d* vertical edge portion, 43*e*, 44*e* vertex portion, 100 gas circuit breaker.

The invention claimed is:

1. A gas circuit breaker comprising:

a filling container filled with insulating gas having arc-extinguishing properties;

a movable side main conductor which is supported and fixed by an insulating support cylinder arranged inside the filling container, is connected to a movable side lead-out conductor connected to an electric power system, and has an exhaust hole for exhausting insulating gas heated and pressurized by an arc generated when a current is broken;

an exhaust shaft which is provided movably in an axis direction of the movable side main conductor inside the movable side main conductor and has a shaft exhaust hole for exhausting the heated and pressurized insulating gas;

an operation mechanism which is coupled to the exhaust shaft and outputs an operation force in an axis direction of the exhaust shaft through an operation rod;

an exhaust cylinder which is provided to an inner circumferential portion of the movable side main conductor and is provided to outer circumferences of the exhaust shaft and the operation rod;

a shaft guide which couples the operation rod with the exhaust shaft and operates along an inner circumferential surface of the exhaust cylinder;

a cylinder which is coaxially coupled to the exhaust shaft and can slide in the axis direction on an inner circumferential surface of the movable side main conductor;

a puffer piston which is fixed to inside of the movable side main conductor and has an opening portion that opens in the axis direction of the movable side main conductor and where the exhaust shaft can slide on an inner circumferential surface of the opening portion;

a movable contact which is electrically connected to the movable side lead-out conductor;

a fixed contact which is electrically connected to a fixed side lead-out conductor connected to the electric power system and is attachable to and detachable from the movable contact; and a sliding member which is mounted on the shaft guide and slides along the exhaust cylinder with no space to the exhaust cylinder, wherein the shaft guide includes a gas suppressing means, which suppresses discharge of the heated and pressurized insulating gas, adjacent to the sliding member in an axis direction, and the gas suppressing means is composed of a protruded portion which is formed on a horizontal surface facing the exhaust cylinder of the shaft guide and which forms a gap between the protruded portion and the exhaust cylinder, and an enlarged portion which is adjacent to the protruded portion and where a gap to the exhaust cylinder is enlarged.

2. The gas circuit breaker according to claim 1, wherein the gas suppressing means is arranged closer to the exhaust shaft than the sliding member.

3. The gas circuit breaker according to claim 1 wherein a plurality of the gas suppressing means are arranged closer to the exhaust shaft than the sliding member.

4. The gas circuit breaker according to claim 1, wherein a plurality of the gas suppressing means, each of which is composed of the protruded portion and the enlarged portion, are arranged closer to the exhaust shaft than the sliding member, and among the plurality of the gas suppressing means, a radial direction cross sectional area of a gap formed between the protruded portions located closer to the exhaust shaft and the exhaust cylinder is greater than a radial direction cross sectional area of a gap formed between the protruded portions located closer to the sliding member and the exhaust cylinder.

5. The gas circuit breaker according to claim 1, wherein a plurality of the gas suppressing means, each of which is composed of the protruded portion and the enlarged portion, are arranged closer to the exhaust shaft than the sliding member, and among the plurality of the gas suppressing means, a gap formed between the protruded portions located closer to the exhaust shaft and the exhaust cylinder is greater than a gap formed between the protruded portions located closer to the sliding member and the exhaust cylinder.

6. The gas circuit breaker according to claim 1, wherein a plurality of the gas suppressing means, each of which is composed of the protruded portion and the enlarged portion, are arranged closer to the exhaust shaft than the sliding member, the protruded portion of each of the gas suppressing means has a vertical edge portion on the exhaust shaft side and an inclined edge portion on the sliding member side, and a vertex portion where the vertical edge portion on the exhaust shaft side and the inclined edge portion on the sliding member side meet is formed at an acute angle.

7. The gas circuit breaker according to claim 6, wherein the protruded portion has a vertex that is the vertex portion, and a right triangle is formed by the vertical edge portion on the exhaust shaft side which is perpendicular from the vertex portion to a horizontal surface of the shaft guide and the inclined edge portion on the sliding member side which is inclined from the vertex portion with respect to the horizontal surface of the shaft guide.

8. The gas circuit breaker according to claim 7, wherein the vertical edge portion on the exhaust shaft side which is perpendicular from the vertex portion of the protruded portion to the horizontal surface of the shaft guide and a horizontal surface on the exhaust shaft side of the shaft guide are on a same plane.

9. The gas circuit breaker according to claim 6, wherein among a plurality of the protruded portions, the protruded portion located closer to the exhaust shaft has a vertex that is the vertex portion, a right triangle is formed by the vertical edge portion on the exhaust shaft side which is perpendicular from the vertex portion to a surface of the shaft guide and the inclined edge portion on the sliding member side which is inclined from the vertex portion with respect to the surface of the shaft guide, the protruded portion on the sliding member side has the vertex portion as its vertex, and a right triangle is formed by the vertical edge portion on the sliding member side which is perpendicular from the vertex portion to a horizontal surface of the shaft guide and the inclined edge portion on the exhaust shaft side which is inclined from the vertex portion with respect to the horizontal surface of the shaft guide.

* * * * *